United States Patent [19]

Sala et al.

[11] Patent Number: 4,836,711

[45] Date of Patent: Jun. 6, 1989

[54] HINGE-ASSEMBLY, PARTICULARLY FOR UNDERWATER MOUNTING

[75] Inventors: Oneglio Sala, Bologna; Paolo Montanari, San Lazzaro, both of Italy

[73] Assignee: Riva Calzoni S.p.A., Milan, Italy

[21] Appl. No.: 198,327

[22] Filed: May 25, 1988

[30] Foreign Application Priority Data

May 25, 1987 [IT] Italy ..... 20666A87

[51] Int. Cl.[4] ..... E02B 7/20

[52] U.S. Cl. ..... 405/92; 405/102; 405/115; 405/87; 16/222; 16/223

[58] Field of Search ..... 405/87, 114, 115, 99, 405/102, 100, 89, 92, 94, 96; 16/222, 223

[56] References Cited

U.S. PATENT DOCUMENTS

| | | | |
|---|---|---|---|
| 196,686 | 10/1877 | Marshall | 405/102 |
| 1,083,818 | 1/1914 | Fitch | 405/99 |
| 3,355,695 | 11/1967 | Overesch | 16/223 X |
| 3,505,822 | 4/1970 | Schulz | 405/100 |
| 3,756,032 | 9/1973 | Solinas | 405/92 |
| 3,857,625 | 12/1974 | Crane et al. | 16/223 X |
| 3,872,541 | 3/1975 | Peterson | 16/223 |
| 4,102,013 | 7/1978 | Newlon | 16/222 |
| 4,706,331 | 11/1987 | Compton | 16/223 |

FOREIGN PATENT DOCUMENTS

| | | | |
|---|---|---|---|
| 429696 | 6/1926 | Fed. Rep. of Germany | 405/89 |

*Primary Examiner*—Randolph A. Reese
*Assistant Examiner*—J. Russell McBee
*Attorney, Agent, or Firm*—Herbert Dubno

[57] ABSTRACT

A hinge assembly for barrier gates, sluice gates and the like attempted to be raised from beneath the sea, has a fixed portion mounted in a base which can be provided with a tunnel affording access to it and enabling a tierod to pull a replaceable body against this fixed portion. The body carries the movable part of the hinge and is provided with a rotating joint enabling compressed air to be delivered to the barrier.

15 Claims, 3 Drawing Sheets

HINGE-ASSEMBLY, PARTICULARLY FOR UNDERWATER MOUNTING

FIELD OF THE INVENTION

Our present invention relates to a hinge assembly and, more particularly, to a detachable or separable hinge assembly for the underwater mounting of equipment, particularly gates or barriers which may be raised pivotally on such a hinge assembly from a lowered position permitting navigation to a raised position protecting a bay or basin from high seas or the like.

BACKGROUND OF THE INVENTION

It is known to provide barriers between channels (e.g. openings to inner basins or bays along a seacoast, river channels, lagoons or like water basins) with barriers which obstruct the channel to prevent the incursion of water from the open seas, e.g. an ocean, upon the development of high seas.

Such barriers may also be used to protect shorelines, coastal installations and offshore installations from high tides, rising seas, storm-driven waves and the like. The barriers have been developed for use in the protection of populated areas and installation or the like in regions where the shoreline or interior body of water must be protected from excessively high tides, seas rising from other causes and from storms or the like.

Among the barriers which have been proposed for such purposes are structures which normally lie below the sea level, e.g. along the bottom of a body of water or channel, and can be pivoted upwardly to form the barrier during bad weather and at those times when the protection is desired. In the lowered state, the structure permits normal naval access.

The gates which may be used can be of the type described in Italian patent application No. 22014A/70.

Submerged hinged assemblies are required which swing about axes for protective purposes.

The hinges should be separable to permit replacement of the gates or barriers for repair or the like.

The hinge assembly required for these purposes must fulfill a number of important requirements. For example, they must be able to operate rapidly and reliably. They must be capable of providing a firm anchorage of the barrier gates to the bottom. Indeed, assembly of the hinges or mounting of the hinge must be effected under very difficult operating conditions, since one must work below the water level and nevertheless provide a highly accurate assembly. The hinges must also permit passage of pneumatic and electrical supply ducts and conduits and must accommodate sensing means for indicating the position of the hinged equipment to a remote station which may provide the control for an entire complex.

OBJECT OF THE INVENTION

It is, therefore, the principal object of the present invention to provide a hinge for submerged installations which allows for rapid operation and reduces to a minimum the number of steps which must be performed to render the hinged equipment operative.

Another object of our invention is to provide a submerged hinge which can be assembled or separated with a minimum of underwater operations, thereby facilitating repair and replacement of parts of the hinge assembly or the structure pivotally mounted thereby.

Still another object of this invention is to provide an improved submerged hinge assembly which is more reliable than earlier hinge structures and which also permits electrical and pneumatic communication through the hinge assembly in an improved way.

It is also an object of the invention to provide a hinge assembly for the purposes described which has all of the attributes indicated to be significant above and also provides improved signalling of the position of equipment hinged on the assembly.

SUMMARY OF THE INVENTION

These objects and others which will become apparent hereinafter are attained, in accordance with the invention, in a disconnectable or detachable hinge, particularly for pivotally mounting equipment in submerged installations, which comprises a fixed portion rigidly anchored to a base, preferably at the bottom of a body of water in which the equipment is to be provided, having an upwardly widening concave seat and provided with a lower tubular extremity extending downwardly through this base into an accessible passage located inside the base. A complementarily shaped insert is mounted in the fixed body and has a support element provided with a pivot and to which the equipment is hinged. The fixed portion is provided with means for mating sealingly with the inner surfaces of the aforementioned concave seat.

The movable member, which is swingable on the pivot, is rigidly connectable to the equipment which is to be mounted by the hinge on the base.

According to the invention, moreover, a tierod is inserted through the lower tubular extremity of the fixed portion from the accessible passage and has means for axially engaging the shaped body which is insertable into the fixed portion. The rod is capable of withstanding axial load and can transfer this load between the fixed portion and the shaped body to anchor the shaped body in place. Means is provided for locking the rod against the fixed portion and for anchoring the rod in the shaped body and means is additionally provided to pass pneumatic and electrical connections between the fixed portion and the shaped body and the shaped body through the pivot to the movable member. In addition, at least one element is provided for transmitting the angular position of the movable member to a location within the fixed portion.

According to another feature of the invention, the concave upwardly widening frustoconical seat is formed on the fixed portion at an upper part oriented toward the outside of the base and is unitary with a cylindrical portion forming the lower part of the fixed portion. The cylindrical portion receives a corresponding substantially cylindrical part of the shaped body. The shaped body, of course, has a frustoconical portion which rests in the conical seat and can be formed with sealing rings around its cylindrical portion for engagement with the cylindrical portion of the fixed portion.

The fixed body or portion has at least one passage or duct for compressed air, at least one passage through which electrical conductors can run, and at least one passage for mechanical transmission of the angular position of the movable member.

The fixed portion has respective openings which can be closed corresponding to the positions of the outlets of the passages formed in the shaped body for the pneumatic, electrical and mechanical connection means.

The fixed portion, moreover, has a duct opening tangentially into the bottom of the cylindrical part or the frustoconical seat and connectable to a drain and to means for supplying clear water under pressure for flushing deposits which may accumulate in the seat prior to insertion of the shaped body therein.

The tierod is provided with protection forming a bayonet coupling with the shaped body which may have similar projections or recesses accommodating the projections of the rod.

The support element has an internally hollow fixed pivot which at one end is connected to a duct communicating with the air passage of the shaped body for delivering air to the equipment which is mounted by the movable member on the pivot.

In addition, the pivot passage or duct has at its other end a rotatable joint communicating with a duct in the pivotally mounted equipment.

According to still another feature of the invention, the tierod is hollow and, when inserted into the shaped body through the fixed portion, communicates with the air passage of the latter and serves as a fitting for communication with a compressor group or set or other air-supply means.

We have found it to be advantageous to provide the support element with one or more intentional-rupture points or intentional-breaking sections which can yield under exceptional impact upon the equipment.

In the event the equipment is a sluice gate or other barrier gate and is in a raised position and is unexpectedly struck by too great waves, a hurricane or the like, rather than cause damage to the gate, therefore, the intentional-break points of the hinge will rupture and cause the gate to break away from the hinge without greater damage.

Since the hinge assembly is detachable as described, a replacement part for the ruptured support element can be easily supplied.

The element from the means for mechanically transmitting the angular position of the movable member can include a toothed segment rigidly fixed to the movable member, a gear meshing with this segment and carried by a shaft rotatably mounted in the shaped body, and a coupling, ball joint or like mechanical transmission at a lower end of this shaft connecting the shaft to a means for monitoring rotation of the latter and thereby signalling the angular position of the movable member. Access is afforded to this shaft through a closable opening of the fixed portion when the shaped body is inserted in the seat.

The electrical connection means can comprise a single pair of conductors or a multiple conductor cable, i.e. a unipolar or multipolar cable, which is connected to the equipment as may be required and may b wound in one or more turns or coils around an end of the pivot of the support element, advantageously on an elastic carrier and then inserted into the corresponding passage of the shaped body. This connector on the shaped body has a water-tight plug which registers with a closable opening of the fixed portion through which it is connectable to the electrical supply lines in the base.

We have found it to be advantageous, moreover, to provide the tubular element of the fixed portion with a controllable gate valve which can be closed during installation and is opened prior to and for the insertion of the tubular tierod. The gate valve insures sealing of the fixed portion against the incursion of water into the tunnel or passage in the base when the shaped body has not yet been mounted in the fixed portion or has been removed for replacement.

The axis of the tierod and the median plane of the rotation of the movable member are different or offset from one another.

BRIEF DESCRIPTION OF THE DRAWING

The above and other objects, features and advantages of our invention will become more readily apparent from the following description, reference being made to the accompanying highly diagrammatic drawing in which.

SPECIFIC DESCRIPTION

Figure 1:
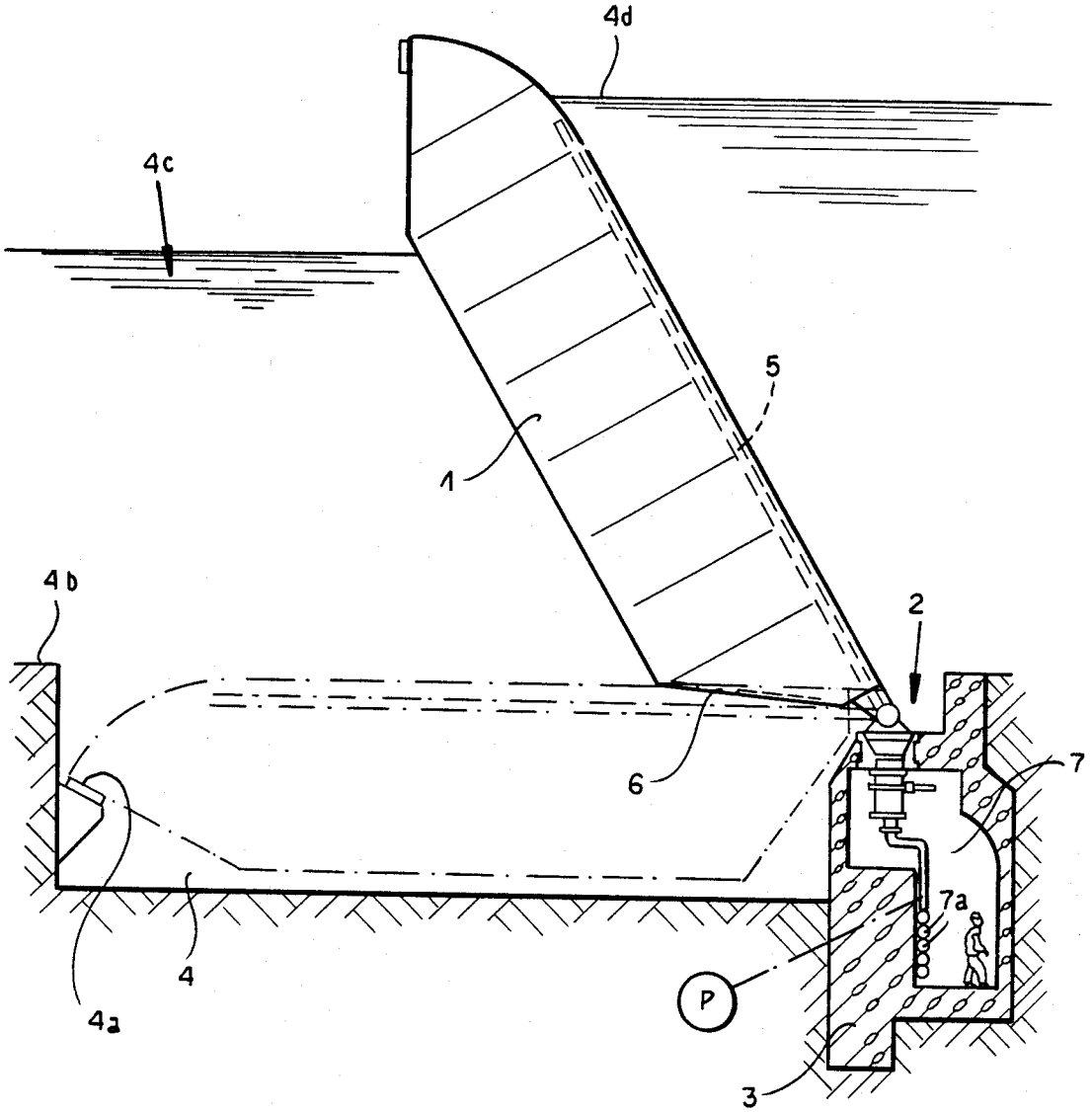
FIG. 1 is a vertical section transverse through the passageway or tunnel in which the hinge assembly of the invention is provided, showing the hinged equipment, namely, a sluice gate or barrier in a side elevational view.

As can be seen from FIG. 1, a movable barrier construction or lock can be formed from a multiplicity of sluice gates or barriers represented generally at 1 and having the configurations of hollow blades. The gates 1 normally lie horizontally as shown in dot/dash lines in FIG. 1, in recess 4, against abutments 4*a* so that, in effect, they lie below the bottom 4*b* of the body of water 4*c* to permit navigation by ships or the like.

The gates 1 are hollow and may be horizontally elongated, i.e. elongated in a plane perpendicular to the plane of the paper in FIG. 1.

The gates 1 are each pivotally mounted at their right-hand edges in a pair of hinge assemblies, one of which can be seen at 2. At the distal end of the gate 1 shown in FIG. 1, a similar hinge can be provided. The hinge assemblies are provided, therefore, close to the edge of the gate 1 which lies proximal to a fixed base 3 built into the floor of the water base and provided with a maintenance and connection passage 7 which can be a tunnel dimensioned to accommodate maintenance and operating personnel for the gate system.

The barrier gates 1 can pivot independently of one another about the horizontal axis defined by the respective hinge assemblies between lowered positions as shown in dot/dash lines in which the barrier gate lies in the respective recess 4 and upright positions as shown in solid line in FIG. 1 in which the barrier gate can hold back a rising body of water as shown in 4*d* in this figure. The elevation of the barrier gate can be effected by forcing air into the barrier gate via an air pipe line 5 and driving water from the barrier gate through an outlet 6. Because of the buoyancy of the air which displaces the water, the barrier gate 1 is swung into the solid line position shown. When air is vented from the barrier gate 1 and water is permitted to enter the gate through the opening 6 the buoyancy effect is eliminated and the barrier gate swings by gravity downwardly into the dot/dash position shown.

Figure 4:
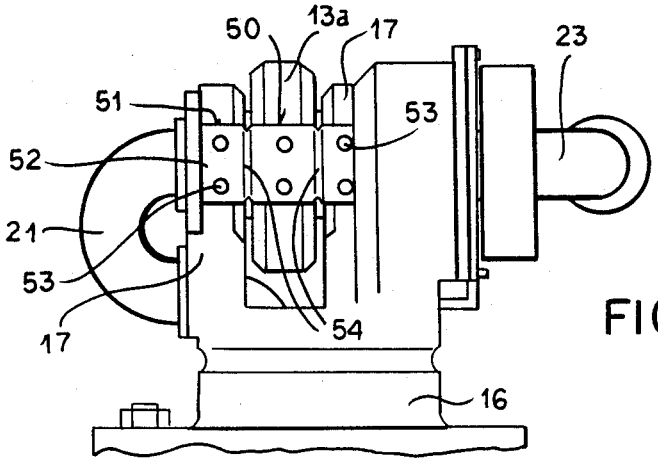
FIG. 4 is an elevational view of a portion of the hinge assembly seen at a right angle to the view of FIG. 3.

The compressed air or other fluid is supplied to the pipe 5 from a compressor group represented at P in FIG. 4 and which may be located in the tunnel, in an equipment room connected to the tunnel, or on land and connected to the hinge assembly by pipelines 7*a* of which a number may be provided, each for control of a respective barrier gate.

The tunnel 7, which is kept dry and sealed from the body of liquid, is passable by operating, assembly and maintenance personnel as noted and enables the personnel to disassemble or separate the hinge assemblies or to reassemble them, for example, for removal and replacement of a gate, repair of a gate or of a hinge assembly or for some other reason. Further equipment can also be housed in the tunnel and the tunnel can also be used for communication lines, e.g. electrical lines for monitoring of the positions of the barrier gates and the like.

When each barrier gate 1 is in its upright position, it permits the development of a difference in water levels along its opposite sides as can be seen from FIG. 1, thereby protecting the basin from both predicted and unpredictable temporary rises in the level of the adjoining sea.

Figure 2:
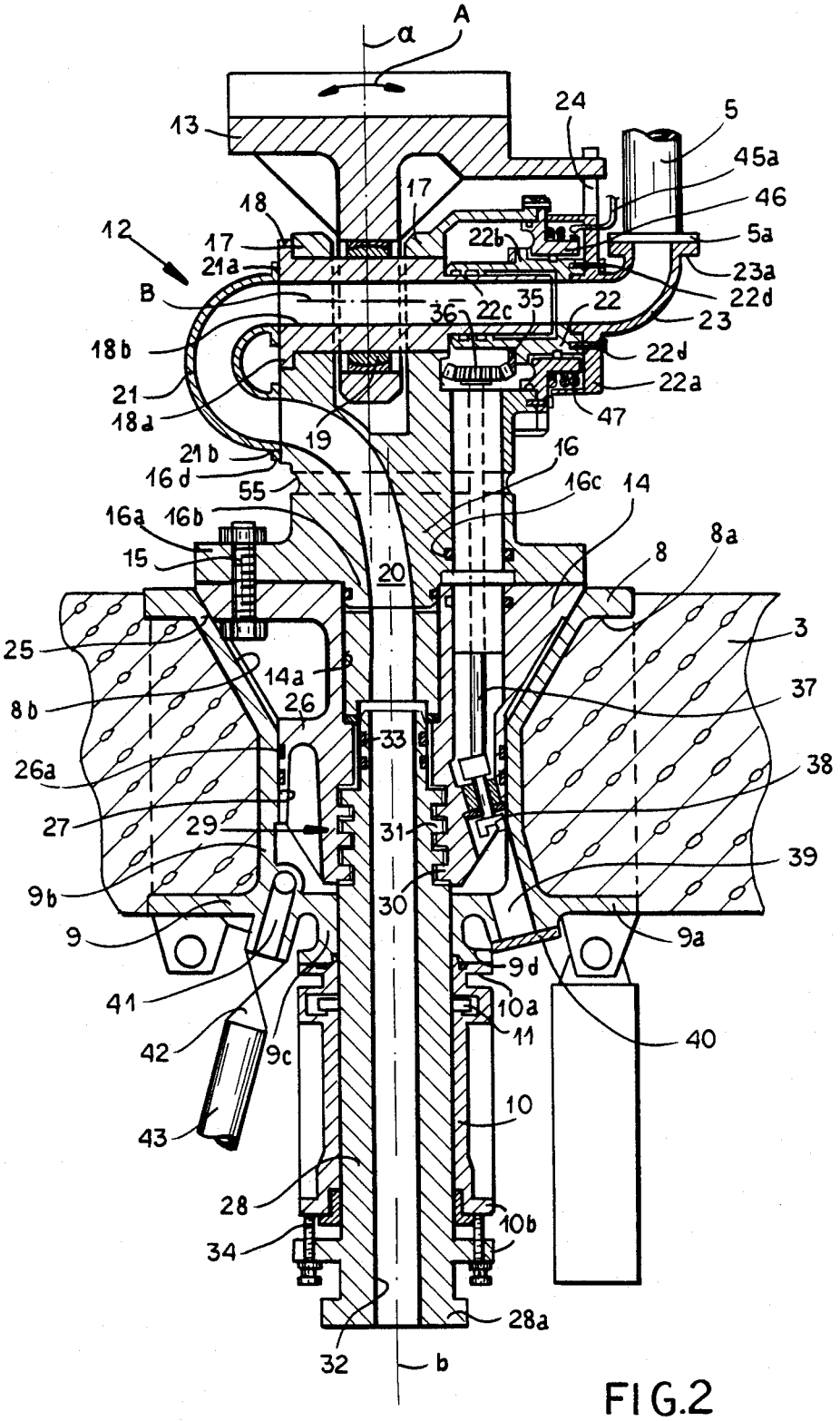
FIG. 2 is an axial section drawn to a greater scale by comparison with FIG. 1 of the hinge assembly.
Figure 3:
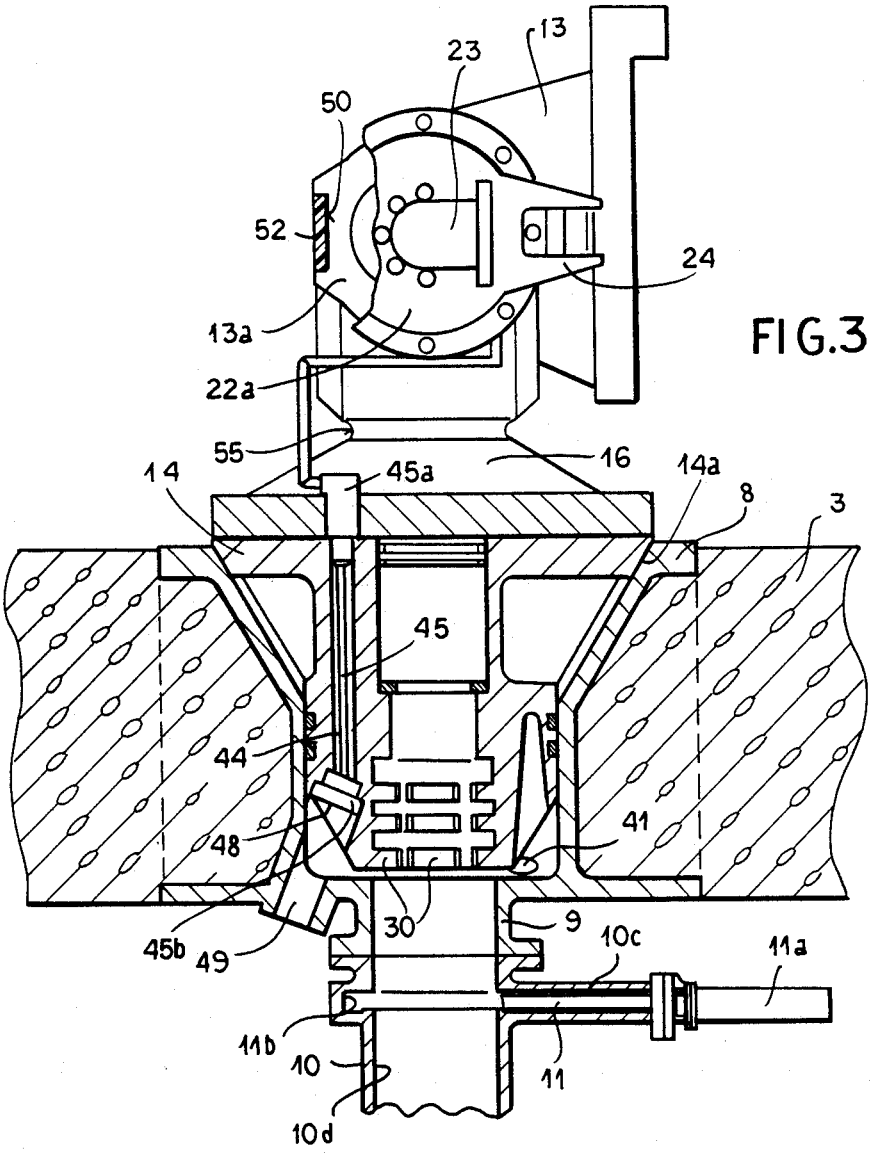
FIG. 3 is a partial axial section taken at a right angle to the section of FIG. 2 but without the tierod and showing parts of the movable member of the hinge in elevation.

In order to facilitate the installation of the barrier gates and their dismounting for maintenance or repair, each hinge assembly is made up of two main parts which can be connected upon mounting and of the construction best seen in FIGS. 2 and 3.

The hinge unit 2 shown in FIGS. 2 and 3, therefore, can comprise a fixed funnel-shaped portion 8 rigidly secured to the concrete of the base 3. To this end, the fixed funnel-shaped portion 8 has a pair of flanges 8*a* and 9*a* between which the concrete is cast to firmly anchor this fixed portion to the concrete.

The upper part of the fixed portion 8 has an upwardly widening frustoconical cavity 8*b* which communicates with a cylindrical portion 9*b* of the lower part of the fixed portion 8.

The lower part each has a cylindrical collar 9*c* having a flange 9*d* by means of which the fixed portion 9 is rigidly connected to a tubular element 10 having flanges 10*a* and 10*b* of which the former can be bolted or welded to the flange 9*d*.

The gate 11 provides a sealing function which assists in sealing the assembly against the incursion of water into the tunnel. This may best be appreciated from FIG. 3 from whence it may be seen that the tubular element 10 carries a lateral sleeve 10*c* in which a gate valve actuator 11*a* is mounted and which can receive the valve plate 11 which can be slid across the bore 10*d* of element 10 to rest in a seat 11*b* formed in the wall of element 10 opposite the valve 11, 11*a*. The actuator 11*a* may be of the hydraulic type and in that case a source of hydraulic fluid can be provided by appropriate pipelines in tunnel 7 to actuate this valve.

In the fixed portion 8, moreover, a mobile hinge element or portion, generally represented at 12, can be mounted.

The mobile element 12 carries a bracket 13 which can be rotated about the horizontal hinge axis as will be described and is connectable to an edge of the gate to be hinged for rotation thereof about a horizontal axis. In FIG. 2, the bracket 13 is shown in a position which corresponds to a fully upright orientation of the barrier gate.

The mobile hinge element 12 comprises an engagement body 14 shaped to fit into the fixed portion 8 and having, therefore, a generally frustoconical surface 14*a* which mates with frustoconical surface 8*b* of the fixed portion 8.

Bolts 15 connect a spherical joint support 16 to the engagement body 14. As can be seen in FIG. 2, member 16 has a horizontal flange 16*a* transversed by the bolts 15 for this purpose. Projecting beyond the horizontal flanges is a cylindrical boss 16*b* which fits into a cylindrical bore 14*a* of the engagement body 14 and is sealed with respect to the latter by an O-ring seal 16*c*.

The cylindrical joint support 16 has a pair of upstanding lugs 17 within which is mounted a pivot shaft 18. The latter has a flange 18*a* to which the flange 21*a* of a pipe bend 21 is sealingly connected, the other flange 21*b* of the pipe bend 21 being sealingly connected to a face 16*d* of the spherical joint support 16.

The pivot shaft 18 is hollow and thus has a bore 18*b* which communicates with the pipe bend 21 at one end and opens into a pipe bend 23 at its opposite end.

Around the shaft 18 between the lugs 17 the pivot portion 13 can be swingably mounted via a cylindrical joint 19 which allows free rotation of the pivot portion 13 about the axis B of the shaft 18 allowing also some play in the direction of arrow A as well as some pivotal movement in the plane of the paper of FIG. 2.

Through the body 14 and the cylindrical joint support 16 a duct or passage 20 can extend, the duct 20 communicating with the pipe bend 21 and, through the bore 18*b*, with the pipe bend 23 which effectively forms a crank which rotates about the axis of the bore 18*b* of the pivot forming a sealing rotating joint 22 therewith which prevents escape of air through these communicating passages. The pipe bend 23 is rotationally coupled with the portion 13 via a fork 24 better seen in FIG. 3. Specifically, the rotating joint 22 has a plate 22*a* which is formed with the fork 24, the latter having tines straddling a projection 13*a* extending from the pivotal portion 13.

The plate 22*a* is connected to a rotatable sleeve 22*b* with gasket seal 22*c* around the tubular shaft 18 and rotatable about the latter. Bolts 22*d* connect the plate 22*a* with the sleeve 22*b*.

The elbow 23, moreover, has a flange 23*a* which is connected to a flange 5*a* of the pipe 5 so that the pipe 5 which runs to the interior of the swinging gate, can be seen to communicate with the elbow 23, the bore 18*b*, the bend 21 and the passage 20 which can be supplied with compressed air in the manner described. Hence the compressed air can be supplied to the sluice gate independently of the angular position of the latter around the hinge axis B.

When the upper conical portion 25 of the body 14 mates with the corresponding surfaces of the fixed portion 8 and a cylindrical bottom portion 26 of the body 14 fits closely within the cylindrical portion 9*b*, the O-ring seals 26*a* between these cylindrical portions can be effective to join these parts of the hinge structure sealingly. Additional gaskets or seals may be provided, e.g. at the cylindrical part 27 of the portion 8 to insure the sealing action.

Fastening of the assembly in the axial direction is effected by means of a tierod 28 which locks the body 14 to the fixed portion of the hinge assembly.

The tierod 28 is insertable from below into the tubular element 10 and can be coupled with the body 14 by a bayonet-type coupling 29.

In the construction illustrated, and as best seen from FIG. 3, the bayonet coupling can include projections 30 extending inwardly on the body 14 and projections 31 extending outwardly of the tierod which are angularly spaced to leave gaps between them so that the projections 31 may pass axially behind the projections 30 in a corresponding relative angular position of the tierod 28 and the body 14, whereupon rotation of the tierod 28 will cause the projections to lock one behind the other and axially fix the body 14 to the portion 8.

The tierod 28 is provided with an axial bore 32 and end-sealing gaskets 33 so that sealing communication is formed between the bore 32 and the passage 20 previously described. The tierod 28 may also have a flange 28*a* to which the compressed air pipeline can be connected in any conventional way. The position of the tierod is locked with the desired axial tension by screws 34.

A toothed segment 35 is connected to the sleeve 22 of the pivot joint which is connected to the plate 22*a* as previously mentioned and rotates relative to the lugs 17 with member 13 about the axis B.

The toothed segment 35 is located at the opposite end of the pivot joint from the bend 21 which delivers the compressed air to the passage 18*a* and meshes with a bevel gear 36 located at the upper end of a succession of articulated shafts represented generally at 37 and which is formed, at its lower end, with a joint 38 leaving the body 14. The connections between the shafts and the joint 38 may be universal joints or ball joints and the joint 38 can be connected to a sensor for transmitting, e.g. via electrical cables, signals representing the angular position of the gate to a remote station.

In the illustrated position of the hinge, the joint 38 is accessible through and extends into an opening 39 of the fixed portion which can be held closed by a flange 40 so as to maintain a tight seal of the hinge against incursion of water into the tunnel during the assembly. After assembly, when the gaskets 26*a* of the body 14 have insured that a water tight joint has been formed between the body 14 and the fixed portion 8, the flange 40 can be removed, allowing axis of the joint 38 to trace the movement of the latter and, based upon its rotation, to obtain information as to the degree of rotation of the barrier gate 1.

At the bottom of the cylindrical part 27 of the fixed portion 8, a duct 41 opens tangentially and is provided with a valve 42 at the extreme end of this duct. A feeding pipe 43 connected to a source of clean water under pressure, e.g. a pump, is connected. When the valve 42 is opened, any deposits which may have collected inside the fixed portion 8 prior to mounting of the body 14 therein can be blasted out of the fixed portion by the pressurized flow of this clean water. During and after assembly of the body 14 into the fixed portion 8, the valve 42 and pipe 43 make it possible to evacuate any water which may be captive between the body 14 and the fixed portion 8.

As can be seen from FIG. 3, within the body 14 there is also provided an axial passage 44 through which an electric cable 45 can extend with sealing connectors 45*a* and 45*b* at its opposite ends.

The cable 45 is wound around a fixed sleeve 46 which is joined (FIG. 2) to the right hand lug 17 at an end of the spherical joint support 16. The cable 45 is wound in a few turns about this sleeve 46 supported by a helical spring which controls and protects the movement of the cable during the pivotal movement of the gate 1. From the plurality of turns, the cable runs at 45*a* to supply electrical equipment which may be located in or on the barrier gate 1 and is movable therewith. Such equipment can include radio signal, loran, electrical light or acoustic beacons or signalling devices capable of signalling the raised position of the gate to navigators in the vicinity.

The water-tight plug 45*b* provides a connector 48 affixed to the body 14 and at the end of the duct 49 opening upwardly into the fixed portion 8. A plug can be mated with the socket 48 or a socket mated with the plug 48 whichever may be the case. The end of the duct 49 can be closed during the assembly stage by a flange like the flange 40 which can be removed after assembly in order to establish the electrical connection with the plug 48. Preferably this flange is removed only after the evacuation of residual water from between the body 14 and fixed portion 8 as mentioned previously.

During assembly of the hinge which has been illustrated, the elements of the hinge which are movable should be fixed in position to facilitate mounting of the body 14 in the fixed portion 8. In particular, we prefer to block all relative movement of members 14 and 16 around the axis B of the pivot shaft 18.

For this purpose, the mobile element 13 can be provided with a recess 50 on a wing 13*a* accommodating the spherical support or bearing 19. Corresponding recesses 51 are provided in the lugs 17 of the support element 16 as shown in FIG. 4. A bar 52, of a material with limited structural strength, e.g. a plastic, can then be bolted in these recesses by screws 53.

During assembly, the locking bar 52 protects the gate and the hinge against stresses of various types which may arise from, for example, changing currents, small collisions, waves or the like which may tend to rotate the gate when such rotation is not desired.

The bar 52, however, is comparatively weak and is torn apart with the initial actuation of the barrier gate to permit the desired pivotal movement during this first actuation and thereafter. Sections 54 of the barrier can be weakened for this purpose.

As previously mentioned, to avoid the destruction of the barrier gate by accidental events such as collision with a boat, storm conditions which greatly exceed the strength of the gate to resist the storm, or the like, the support element 16 is provided with an intentional break zone 55 designed to preferentially rupture upon the occurrence of such an event. This rupture will have the effect of breaking the movable parts of the hinge away from the fixed portion 8 and will, therefore, allow the gate to move away from the hinge structure for subsequent recovery without damage. When the causes of the breakage have ceased, the support element 16 can be replaced and the gate remounted, permitting rapid restoration of the operability of the barrier complex.

Alternatively, we may make the bolts 15 with intentional break zones or locally weakened construction so that the entire support element can be torn away from the body 14 as described. In this case, the boss 16*b* is not present and the precise alignment of the parts must then be accomplished utilizing a precision positioning of the bolts.

As can be seen from FIG. 2, the vertical plane (a) through the bearing 19 need not be aligned with the axis (b) of the tierod 28, i.e. the two can be horizontally offset somewhat from one-another.

This has been found to be advantageous since it allows for a maximum compactness of the structure and permits the shaft 37, for example, to remain within the diameter of the cylindrical portion of the body 26.

The mounting of a barrier gate utilizing the principles of the present invention requires first the construction of a base 3 in which the fixed portions 8 are inserted and anchored during the casting of the concrete and in predetermined positions.

In the construction of the base, templates or the like are used to insure the correct placement of fixed portions 8 for maximum possible accuracy in the final assembly of the barrier gates. The members 14 are then inserted and mounted in place in the manner described and after the parts 13 thereof have been bolted to the edges of the gates.

Possible assembly imperfections of a limited amount are compensated by the play of the spherical joint 19 and play along the axis of the pivot 18 between the lug 17 and the wing of member 13 carrying the bearing 19.

The sluice gate 1 is brought into the assembly region after the fixed portions 2 have been properly positioned, and is lowered into the water with the bodies 14 disposed vertically and turned downwardly. The bodies 14 are blocked against movement relative to the gates by the rupturable bars 52.

The fixed portion 8 has previously been provided with the washing circuit 43, 42, 41, closed by the valve 43, while the ducts 39 and 49 are closed by respective flanges. In this stage the gate valve 11 remains closed. As a consequence, watertight sealing of the tunnel 7 against the overlying body of water is insured.

The bodies 14 of the hinges are then inserted into the corresponding fixed portions 8. Prior to and during this operation, the fixed portions 8 are flushed with clean water via the passages 41. Once the bodies 14 have come to rest in their respective seats, the tierods 28 are inserted upwardly from the tunnel and when they approach the valve 11, each gate valve 11 is opened, the tierod further inserted and air is fed through the tierod. The bayonet catch 29 is engaged, e.g. by a rotation of the tierod 28 manually or through the aid of a hydraulic rotating device of the like. After the bayonet coupling has been rotated in the position of axial locking, the desired degree of downward force is applied by the tierod 28 on the fixed body 14 with the aid of screws 34.

When the body 14 has been thus mounted, the space beneath the body 14 can be emptied by a purge valve located along the duct 43 and the required electrical and mechanical connections can be made to the hinge operating from within the tunnel 7.

We claim:

1. A separable hinge, especially for underwater mounting of equipment on a base, comprising:

a fixed portion rigidly affixed to said base and having an upwardly widening concave seat at an upper end of said fixed portion and a tubular lower part at an opposite end of said fixed portion opening into a passage in said base;

a shaped body matingly receivable in said concave seat and provided with sealing means cooperating with said tubular lower part for sealing thereagainst;

a support element on said shafted body provided with a pivot;

a movable member connected to said equipment and mounted for angular displacement on said pivot;

a tierod inserted through said tubular lower part of said fixed portion upwardly into engagement with said shaped body 16 and formed with a releasable coupling therewith adapted to withstand force along a vertical axis and means for bracing said tierod along said axis against said fixed portion for drawing mating surfaces of said shaped body and said concave seat against one another to lock said shaped body to said fixed portion;

means forming a rotating joint between said movable member and said support element and extending through said body and said fixed portion for pneumatic communication with said equipment;

means traversing said fixed portion and said body for effecting a flexible electrical connection with said equipment; and mechanical transmission means extending through said body and operatively connected to said movable member for signalling an angular position of said movable member about said pivot.

2. The separable hinge defined in claim 1 wherein said tubular lower part has a cylindrical shape below said seat and said body has a frustoconical portion complementarily received in said seat and a tubular cylindrical boss extending into and provided with sealing members sealingly engaging said tubular lower part.

3. The separable hinge defined in claim 1 wherein said body is formed with at least one air passage forming part of said means forming a rotating joint between said movable member and said support element and extending through said body and said fixed portion for pneumatic communication with said equipment, at least one electrical-connection passage forming part of said means traversing said fixed portion and said body for effecting a flexible electrical connection with said equipment, and at least one mechanical-transmission passage forming part of said mechanical transmission means extending through said body and operatively connected to said movable member for signaling an angular position of said movable member about said pivot.

4. The separable hinge defined in claim 3 wherein each of said passages in said body is provided with a respective means of said fixed portion for closing the respective passage in said body to prevent incursion of water through the fixed portion into said passage in said base.

5. The separable hinge defined in claim 1, further comprising a duct formed in said fixed portion and opening tangentially therein close to said seat and connected with means for supplying fresh water to said seat for purging same of accumulations prior to mounting of said body in said seat, and with means for draining trapped water from said seat.

6. The separable hinge defined in claim 1 wherein said releasable coupling is a bayonet catch formed between said tierod and said body.

7. The separable hinge defined in claim 1 wherein said pivot is a tubular shaft and said means forming a rotating joint between said movable member and said support element and extending through said body and said fixed portion for pneumatic communication with said equipment includes a duct passing through said body and communicating with said tubular shaft at one end thereof for delivering air to said tubular shaft, and a further duct at an opposite end of said shaft for connecting same to said equipment.

8. The separable hinge defined in claim 7 wherein said tierod is hollow and communicates with said duct passing through said body to deliver air under pressure thereto.

9. The separable hinge defined in claim 1 wherein said support element is provided with at least one predetermined intentional-break zone capable of rupture upon an exceptional impact upon said equipment to separate said equipment from said base and limit damage to said equipment.

10. The separable hinge defined in claim 1 wherein said mechanical transmission means extending through said body and operatively connected to said movable member for signalling an angular position of said movable member about said pivot includes a toothed segment affixed to said movable member, a gear meshing with said segment rotatable on said body, a rotatable shaft connected with said gear and extending through said body, and a joint formed at a lower end of said shaft and to which access is afforded through a closable passage formed in said fixed portion.

11. The separable hinge defined in claim 1 wherein said means traversing said fixed portion and said body for effecting a flexible electrical connection with said equipment includes a cable extending through a cable passage formed in said body and provided at a lower end of said cable with a seal closing said cable passage and with a connector for plug-and-socket connection with said cable, the cable being formed at an upper end with a plurality of turns around said pivot before being connected to said equipment.

12. The separable hinge defined in claim 11 wherein said cable is wound around a spring elastically supporting said turns on said pivot.

13. The separable hinge defined in claim 1 wherein said tubular lower part is provided with a controllable gate valve sealing said fixed portion prior to assembly of the hinge to prevent incursion of water into said passage when said shaped body is not mounted in said seat.

14. The separable hinge defined in claim 1 wherein said axis of said tierod is horizontally offset from a median rotation plane of said movable member.

15. The separable hinge defined in claim 1 wherein said equipment is a swingable barrier against the incursion of high water to a protected basin.

* * * * *